US006991070B1

(12) United States Patent
Sanz Gamboa

(10) Patent No.: US 6,991,070 B1
(45) Date of Patent: Jan. 31, 2006

(54) ELEVATOR GUIDE ASSEMBLY SYSTEM

(75) Inventor: Jesús Sanz Gamboa, Vera de Bidasoa (ES)

(73) Assignee: S.A. de Vera (savera), Vera de Bidasoa (ES)

( * ) Notice: Subject to any disclaimer, the term of this patent is extended or adjusted under 35 U.S.C. 154(b) by 0 days.

(21) Appl. No.: 10/149,373

(22) PCT Filed: Dec. 23, 1999

(86) PCT No.: PCT/ES99/00404

§ 371 (c)(1),
(2), (4) Date: Jun. 5, 2002

(87) PCT Pub. No.: WO01/47796

PCT Pub. Date: Jul. 5, 2001

(51) Int. Cl.
*B66B 7/02* (2006.01)

(52) U.S. Cl. ..... 187/408; 187/406; 238/243

(58) Field of Classification Search ..... 187/406, 187/408, 414; 238/243, 244, 248, 254
See application file for complete search history.

(56) References Cited

U.S. PATENT DOCUMENTS

| | | | | | |
|---|---|---|---|---|---|
| 1,479,531 | A | | 1/1924 | Booher | |
| 1,888,018 | A | * | 11/1932 | Shanafelt | 187/408 |
| 2,316,976 | A | * | 4/1943 | Sahlin | 187/408 |
| 2,481,983 | A | | 9/1949 | Dell | |
| 2,500,539 | A | * | 3/1950 | Granath | 187/408 |
| 3,982,692 | A | * | 9/1976 | Feyrer et al. | 187/408 |
| 4,079,817 | A | * | 3/1978 | Tosato et al. | 187/408 |
| 4,324,360 | A | * | 4/1982 | Sun et al. | 187/408 |
| 4,431,087 | A | * | 2/1984 | Karol | 187/408 |
| 4,577,729 | A | * | 3/1986 | Karol | 187/408 |
| 5,020,641 | A | * | 6/1991 | Olsen et al. | 187/408 |
| 6,305,615 | B1 | * | 10/2001 | Traktovenko | 187/408 |

FOREIGN PATENT DOCUMENTS

| | | | | |
|---|---|---|---|---|
| DE | 2526448 | A1 * | 12/1976 | 187/408 |
| EP | 0149 773 | | 7/1985 | |
| EP | 0 381 852 | | 8/1990 | |
| EP | 381852 | A1 * | 8/1990 | 187/408 |
| GB | 4762 | | 7/1910 | |
| GB | 251534 | | 10/1925 | |
| GB | 694510 | A * | 7/1953 | 187/408 |
| GB | 804743 | A * | 11/1958 | 187/408 |
| JP | 11-11820 | | 1/1999 | |
| WO | WO 96/00183 | | 1/1996 | |

* cited by examiner

*Primary Examiner*—Kathy Matecki
*Assistant Examiner*—Thuy V. Tran
(74) *Attorney, Agent, or Firm*—Lucas & Mercanti LLP

(57) ABSTRACT

A lift guide joint system for joining two guides having a joint-bridge plate connected to each side of the two guides is disclosed. The joint-bridge plate has a central body placed on an upper surface of the wings of the two guides. An upper flap of the joint-bridge plate extends along the blade-head portion of the guides and a lower flap of the joint-bridge extends along the wing portion of the guides. The central body is screwed to the wing portions so that the upper flap presses against the blade-head in order to align the two guides.

14 Claims, 6 Drawing Sheets

ELEVATOR GUIDE ASSEMBLY SYSTEM

Figure 1:
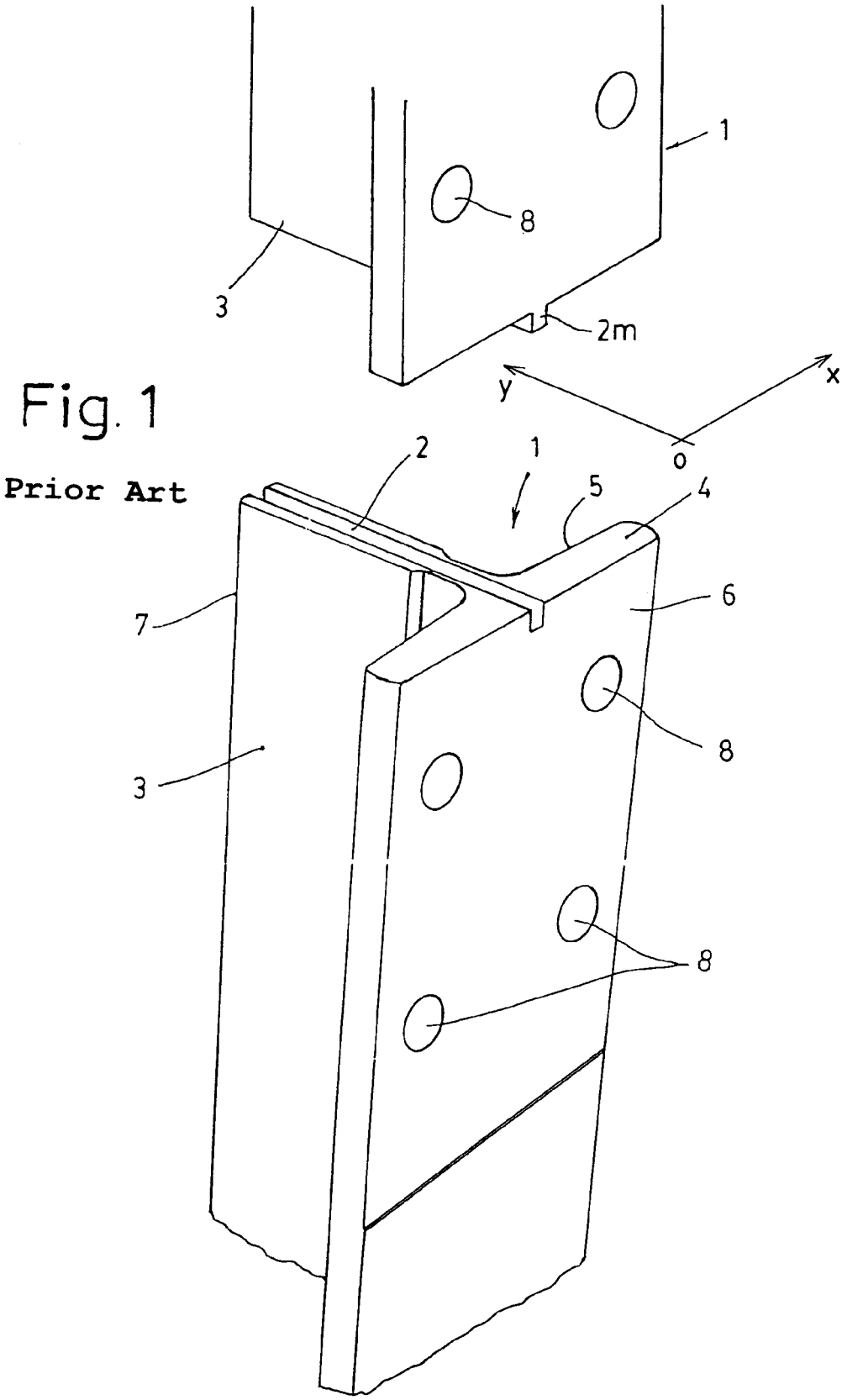
Fig. 1 Prior Art

Lift guides require higher and higher quality coefficients each day due to the increase in speed of the lifts and due to the comfort demands of the users.

On the other hand, and even in the event that a high quality is achieved in the manufacture of the guides, the assembly problem still exists, as this requires measurements, regulation and adjustments of the joints of the different guide lengths, which must be done in the place where the lift is going to be located and by qualified personnel that do not belong to the manufacturer of the guides.

It is perfectly understood that any improvement in the simplification of the assembly will represent a great advance in this technological field.

A traditional guide comprises blade-head and wings-base, each piece of guide being joined to the next one by grooving and tonguing.

The applicant considers that one of the main causes of these problems is the grooving and tonguing currently used to join the different lengths of the guides, so it is not used in the invention.

The system targeted by the invention is based on using a joint-anchorage plate on each side of the guides and on each connection, and which are anchored (screwed) to the wings, preferably above them.

The joint-anchorage plates of each joint may have some joint means between them, but this is not necessary.

With this system the joined guides are aligned according to the OX, OY axes.

Yy axis: On anchoring the screws a side pressure of a flap of the joint plate is created on the head area so that they centre the heads of the two guides, minimising the gap between them and aligning the two lengths of guide.

Xx axis: By machining the upper or lower part of the wings, which is done at the same time as the machining of the head, the gap in the upper part is minimum and the two guide lengths are automatically aligned.

The guides do not require machining tongue and groove (grooving and tonguing joint) or planing of the base.

Advantages of the system:

- The guides are the same on both sides on not having tongue and groove.
- The tongue does not have to be spliced with the groove with the subsequent time saving.
- The guides are automatically aligned when the screws are tightened, which saves a lot of time.
- The gaps in the joints are much less as it only affects the thickness of the head so the joint quality is much higher.
- Only one wrench is required to tighten the screws (as a system is used which avoids turning the screw).
- It is not necessary to control the roller path because the joint is guaranteed by the assembly system on not having adjustments (time saving and no need for specialised personnel).
- The plate weighs less as it is in two parts, so it is better to handle.
- The plate joint is rigid with respect to both OX and OY axes, without the possibility of the guides moving on the plate.

For a better understanding of the object of this invention, a preferential form of practical execution is illustrated in the drawings, subject to accessory changes that take nothing away from its foundation.

FIG. 1 is a perspective view of the current already known guide.

Figure 2A:
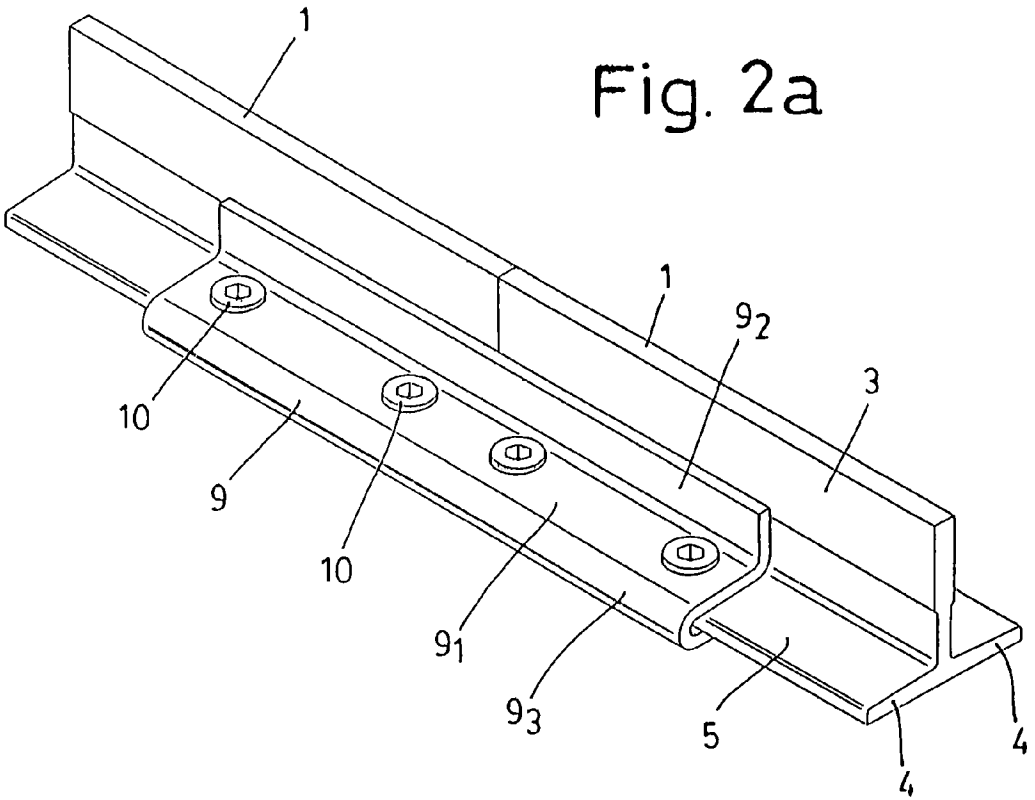

FIG. 2*a* is a perspective view of a first practical execution of the system targeted by the invention with the joint-bridge plates already mounted on the guides.

Figure 2C:
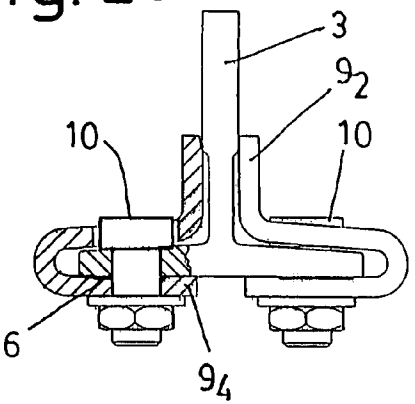
Figure 2B:
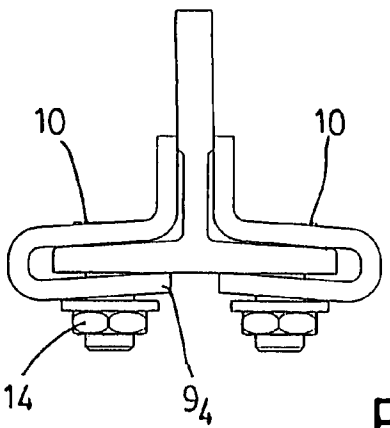

FIG. 2*b* is a side view of FIG. 2*a* with the screws still not tightened.

FIG. 2*c* is a side view of FIG. 2*a* with the screws tightened.

Figure 3A:
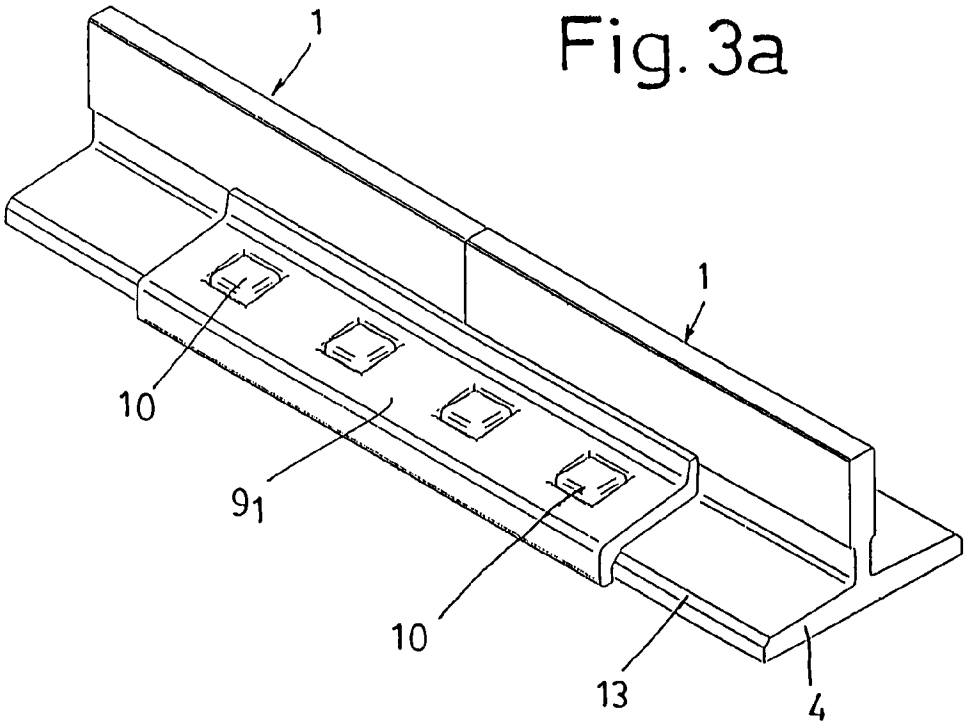

FIG. 3*a* is a perspective view of a second practical execution of the system targeted by the invention with the joint-bridge plates already mounted on the guides.

Figure 3B:
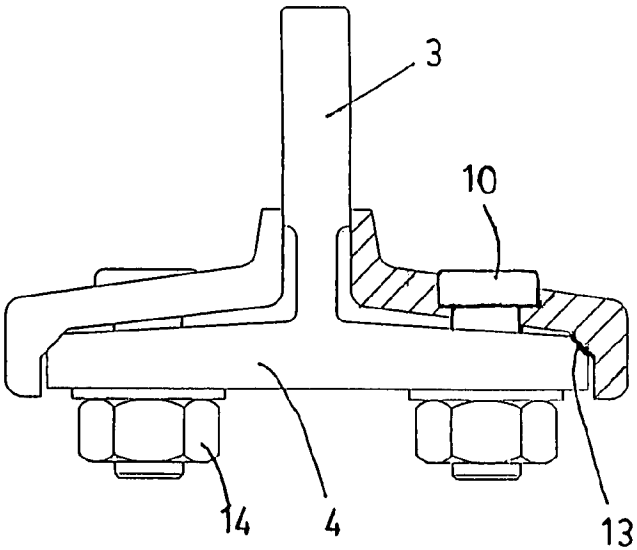

FIG. 3*b* is a side view of FIG. 3*a*.

Figure 4A:
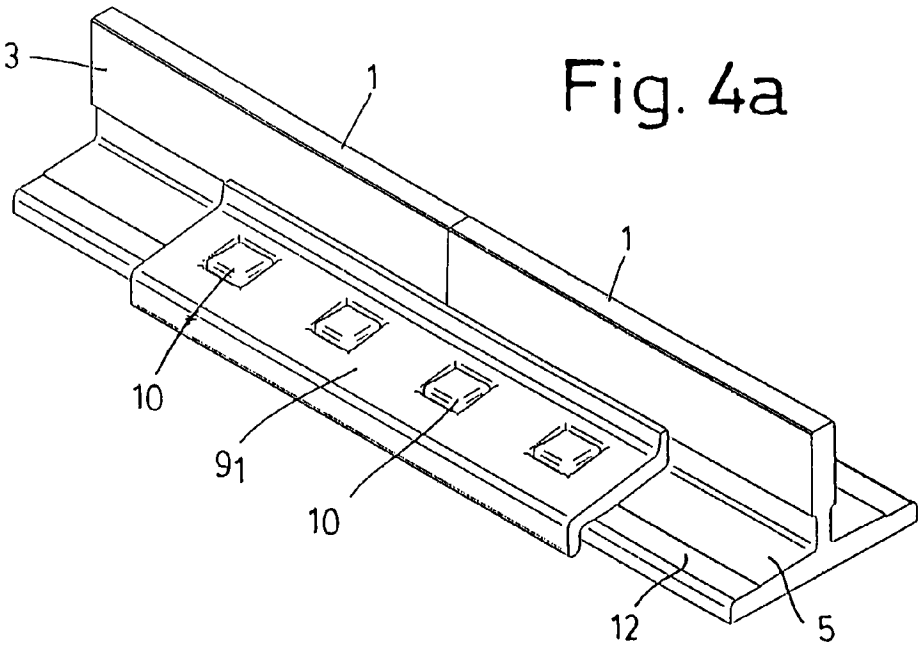

FIG. 4*a* is a perspective view of a third practical execution of the system targeted by the invention.

Figure 4B:
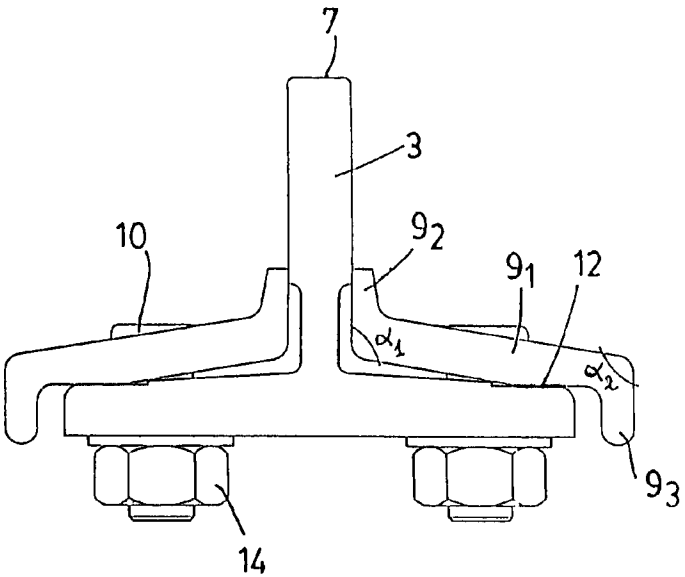

FIG. 4*b* is a side view of FIG. 4*a*.

Figure 5A:
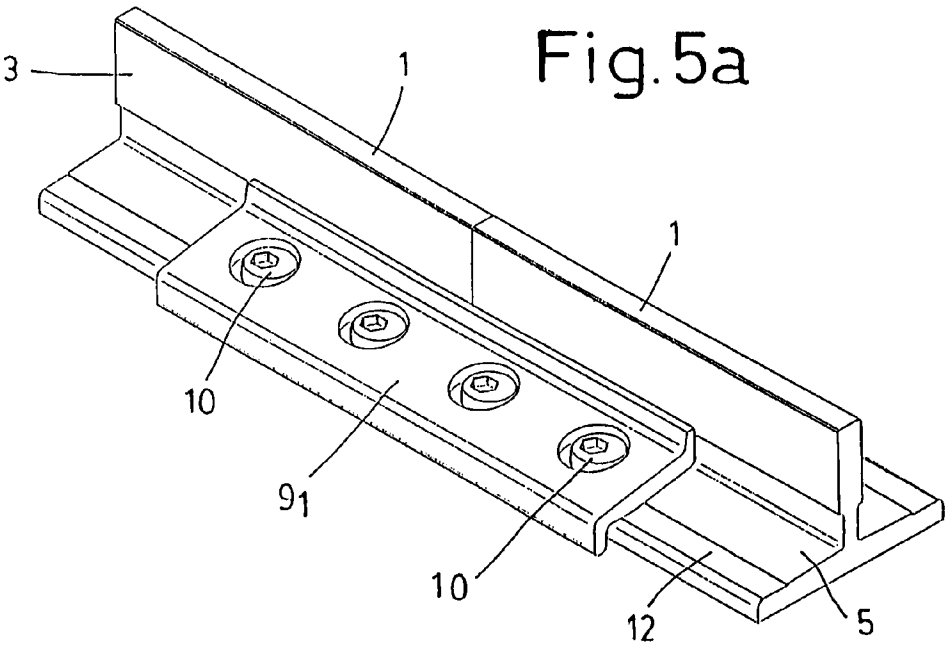

FIG. 5*a* is a perspective view of a fourth practical execution of the system targeted by the invention.

Figure 5B:
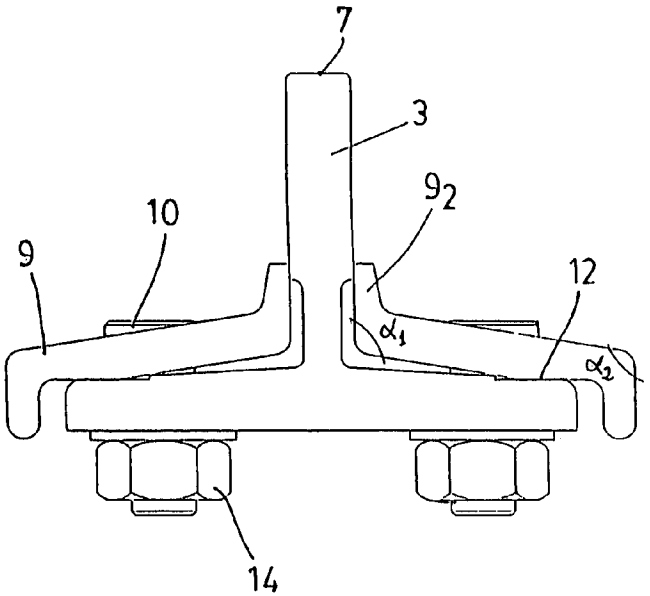

FIG. 5*b* is a side view of FIG. 5*a*.

Figure 6A:
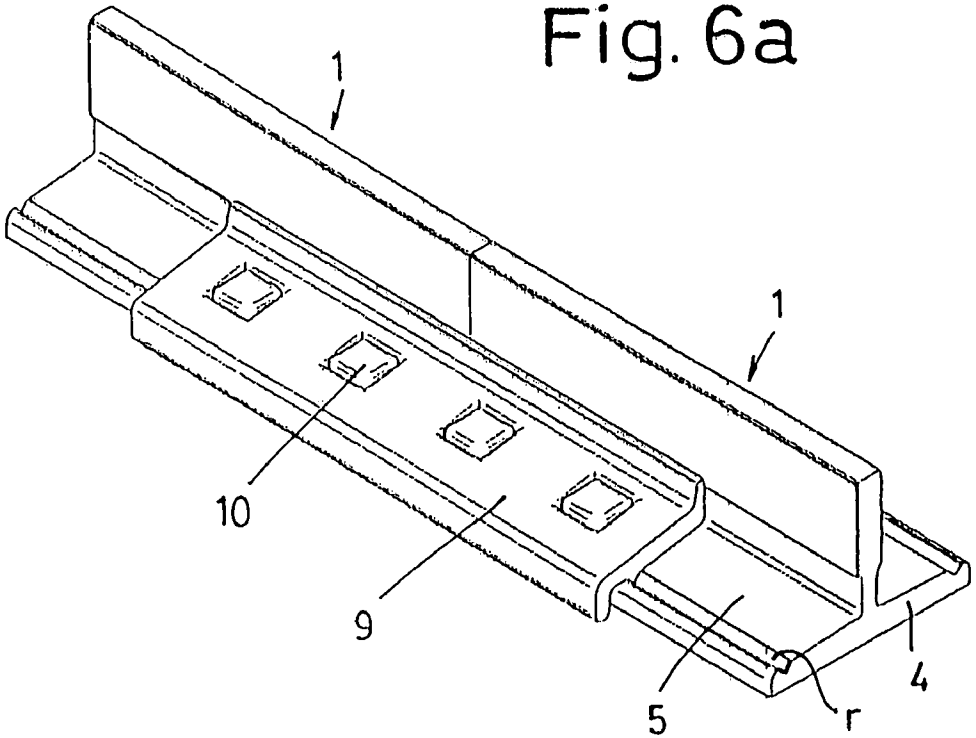

FIG. 6*a* is a perspective view of a fifth practical execution of the system targeted by the invention.

Figure 6B:
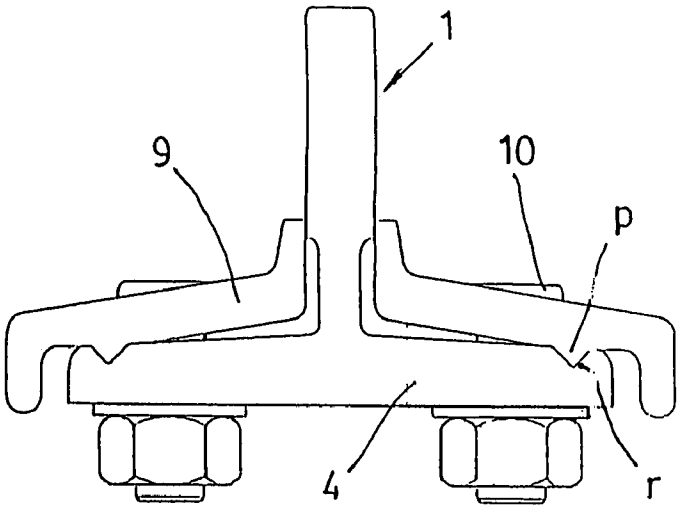

FIG. 6*b* is a side view of FIG. 6*a*.

Below an example of a non-limiting practical execution of this invention is described.

FIG. 1 shows a lift guide (1) already known with its groove (2) combined with the tongue (2) of the next guide that it must be joined to.

This type of guide (1) is comprised of a blade-head (3) and wings (4) with divergent upper surface (5) and lower surface (6).

In order for the lift to correctly slide on these guides (1) already known, the following conditions must be satisfied for a good alignment on the OX and OY axes of the guides:

- The upper surface (7) of the head (3) must be strictly parallel to the lower surface (6) of the wings (4), which involves two independent machining operations, the upper surface (7) of the head (3) normally being brushed and the lower surface (6) of the wings (4) planed.
- Minimum play in the grooving and tonguing of the combined groove (2) and tongue.
- To join the guides (1) together a plate is used (not illustrated), screwed to the lower surfaces (6) of the wings (4) of both guides (1), which means that the play between the relative screws and holes (8) must be thoroughly controlled.
- Assembly of the guides with the relative adjustment/alignment means to be handled "in situ" at the installer's discretion (the operator does not usually come from the guide manufacturer).

In the system targeted by the invention the grooving and tonguing joint and planing is no longer used.

Two guides (1) are seen in FIG. 2*a*, butt-joined by means of two equal joint-bridge plates (9), one on each side.

A joint-bridge plate (9) is comprised of a central body ($9_1$), which is partially placed on the upper surface (5) of the wings (4) of the two guides (1) to be spliced, and which extends along one edge with an upper flap ($9_2$) in contact with the head (3) and on the other edge with a lower flap ($9_3$).

Preferably the upper and lower flaps ($9_2$), ($9_3$) form obtuse angles ($\alpha_1$) ($\alpha_2$) with the central body ($9_1$) for example. (FIG. 4*b*).

In this first practical execution the lower flap ($9_3$) extends below the wings (4) of the guides (1).

The joint-bridge plates (9) are secured to the guides (1) with tightening screws (10) arranged on the central body ($9_1$).

In this first practical execution, when the screws (10) (FIG. 2*c*) and anchorage nut (14) are tightened, the support area between plate (9) and guides (1) is the lower surface (6) of the wings, with the extension ($9_4$) of the lower flap ($9_3$).

In the case of FIG. 2 the grip is due to the nut (14) without the head of the screw (10) pressing against the joint-bridge plate (9) as seen in sectioned FIG. 2*c*.

In the rest of the practical executions illustrated it is the screw head (10) that exercises pressure on the joint-bridge plate (9).

When the screws (10) are tightened, this gives rise to a side thrust force of the upper flap ($9_2$) against the head (3) so that the heads (3) of the two guides (1) to be joined together are centred, as a result minimising the gap between them and aligning both guides (1) on the OY axis.

In the third and fourth executions (FIGS. 4 and 5) the joint-bridge plate (9) presents a central body ($9_1$) and similar upper ($9_2$) and lower ($9_3$) flaps that are preferably parallel.

In the manufacturing process the upper surface (5) of the wings (cuts (12) as a support area for the central body ($9_1$) and the upper surface (7) of the head (3) are machined at the same time thus managing to align both guides on the OX-axis, the gap in that direction being minimum.

By tightening screws (10) the thrust force of the upper flap ($9_2$), already explained, on the head (3), gives rise to the OY alignment.

In this case, applicable to other practical executions, the relative openings and heads of screw are non-rotating, for example square.

In the variant of FIG. 5 the head of tightening screw (10) is a side moving cam.

In the second practical execution, FIG. 3, the tightening screws (1) are non-rotating as in the variant of FIG. 4, but the support area of the joint-bridge plate (9) on the guide (1) is carried out on a bevelling (13) carried out on the upper edge of the wings (4).

In FIGS. 6*a*, 6*b*, it can be seen that the joint-bridge plate (9) has a longitudinal protuberance (p), which is located in a combined channel Ⓡ executed in the wings (4) of the guide (1).

In the figures, the channel (r) appears with a wedge shape and on the upper surface (5) of the wings, but it can be placed in any part of the wings and may have any shape whatsoever, the shape and location of the protuberance (p) resulting, therefore, from the plate (9).

In all the executions explained, the "in situ" installer just has to place the two joint-bridge plates (9) of each joint (one on each side of each joint), tighten the screws and the running path is left without having to make readjustments, settings or measurements, like a continuous guide, perfectly aligned according to the OX and OY axes.

The invention claimed is:

1. Lift-guide joint system for joining two lift guides characterized in that each of said lift guides has a blade-head and two wings perpendicular to said blade-head, said blade-head having an upper surface that is parallel to a lower surface of said wings, a joint-bridge plate connects each side of the joint between the two lift guides, the joint-bridge plate being comprised of a central body placed on an upper surface of the wings of the two lift guides, an upper flap of the joint-bridge-plate extends along the blade-head of the two lift guides and a lower flap of the joint-bridge plate extends along the wings, the upper and lower flaps forming obtuse angles with the central body, the central body being screwed to the wings so that the upper flap presses sideways against the blade-heads.

2. The lift guide joint system of claim 1, characterized in that the lift guide has a cut on the upper surface of the wings where the central body of the joint-bridge plate is placed.

3. The lift guide joint system of claim 1, characterized in that the lift guide has a beveling on an upper edge of the wings where the joint-bridge is placed.

4. The lift guide joint system of claim 1, characterized in that the upper and lower flaps are similar.

5. The lift guide joint system of claim 1, characterized in that the screws are non-rotating.

6. The lift guide joint system of claim 1, characterized in that the joint-bridge plate has a longitudinal protuberance which is located in a combined channel of the wings.

7. The lift guide joint system of claim 1, characterized in that the screws are side moving cams.

8. Lift guide joint system for joining two adjacent lift guides, each of said lift guides having a blade-head and two wings perpendicular to the blade-head, said adjacent lift guides forming a joint therebetween, lift guide joint system comprising a joint-bridge plate which connects each lift guide at the side of the joint between the two lift guides, the joint-bridge having a) a central body which is placed on an upper surface of the wing of each lift guide, b) an upper flap which extends along one edge of the blade-head of each lift guide, and c) a lower flap which extends along the wing of each lift guide, said upper and lower flaps forming obtuse angles with the central body, wherein the central body of the joint-bridge plate is screwed to the wing of each lift guide so that the upper flap presses sideways against the blade-head of each lift guide, and wherein said blade-head having an upper surface that is parallel to a lower surface of said wings.

9. The lift guide joint system of claim 8, wherein the central body is placed in a cut of the adjacent wings.

10. The lift guide joint system of claim 8, wherein the joint-bridge plate is placed in a beveling of an upper edge of the adjacent wings.

11. The lift guide joint system of claim 8, wherein the upper flap and the lower flap are similar.

12. The lift guide joint system of claim 8, wherein the screws are non-rotating.

13. The lift guide joint system of claim 8, wherein the joint-bridge plate has a longitudinal protuberance located in a combined channel of the adjacent wings.

14. The lift guide joint system of claim 8, wherein the screws are side moving cams.

* * * * *